US009845757B2

(12) United States Patent
Naruse

(10) Patent No.: US 9,845,757 B2
(45) Date of Patent: Dec. 19, 2017

(54) CONTROLLER FOR DIESEL ENGINE

(71) Applicant: DENSO CORPORATION, Kariya, Aichi-pref. (JP)

(72) Inventor: Hideo Naruse, Kariya (JP)

(73) Assignee: DENSO CORPORATION, Kariya (JP)

( * ) Notice: Subject to any disclaimer, the term of this patent is extended or adjusted under 35 U.S.C. 154(b) by 130 days.

(21) Appl. No.: 14/872,730

(22) Filed: Oct. 1, 2015

(65) Prior Publication Data

US 2016/0097339 A1 Apr. 7, 2016

(30) Foreign Application Priority Data

Oct. 2, 2014 (JP) ..... 2014-204124

(51) Int. Cl.
*F02D 41/14* (2006.01)
*F02D 19/06* (2006.01)
*F02D 35/02* (2006.01)

(52) U.S. Cl.
CPC ..... *F02D 41/1467* (2013.01); *F02D 19/0649* (2013.01); *F02D 35/023* (2013.01); *F02D 35/028* (2013.01); *F02D 2200/0612* (2013.01)

(58) Field of Classification Search
CPC ..... F02D 41/401; F02D 41/1467; F02D 41/0055; F02D 41/2416; F02D 41/1466; F02D 41/147; F02D 2041/1432; F02D 35/023; F02D 35/028; F02D 35/027; F02D 2200/0612; F02D 2200/0611; F02D 19/061; F02D 19/0636; F02D 19/0649; F02D 19/0634; F02D 19/085; F02P 5/152; F02P 5/153; G01M 15/08; G01L 23/22; G01L 5/14; G01N 25/58
See application file for complete search history.

(56) References Cited

U.S. PATENT DOCUMENTS 5,486,107 A * 1/1996 Bonne ..... G01N 33/2829 374/43
7,987,696 B2 8/2011 Kuronita et al.
8,191,532 B2 * 6/2012 Folkerts ..... F02D 35/023 123/406.11
2008/0262699 A1 * 10/2008 Hasegawa ..... F02D 35/023 701/103
2009/0145199 A1 6/2009 Kuronita et al.
2010/0089363 A1 * 4/2010 Moriya ..... F02D 35/023 123/435
2011/0224886 A1 * 9/2011 Wang ..... F02D 19/08 701/103
2016/0208764 A1 * 7/2016 Mann ..... F02P 5/152

FOREIGN PATENT DOCUMENTS

JP 2014-148906 8/2014
JP 2015-49809 3/2015
JP 2016-169660 9/2016

* cited by examiner

*Primary Examiner* — Lindsay Low
*Assistant Examiner* — George Jin
(74) *Attorney, Agent, or Firm* — Nixon & Vanderhye P.C.

(57) ABSTRACT

A controller for a diesel engine has a fuel injector which injects a fuel into a cylinder. The controller has a middle-combustion time computing portion which computes a middle-combustion time period that has elapsed from the fuel is injected until a half of the fuel has combusted, based on a detection value of a cylinder pressure sensor. Further, the controller has a fuel component computing portion which computes a ratio of a carbon quantity relative to a hydrogen quantity contained in the fuel based on the middle-combustion time period.

13 Claims, 7 Drawing Sheets

CONTROLLER FOR DIESEL ENGINE

CROSS-REFERENCE TO RELATED APPLICATION

This application is based on Japanese Patent Application No. 2014-204124 filed on Oct. 2, 2014, the disclosure of which is incorporated herein by reference.

TECHNICAL FIELD

The present disclosure relates to a controller for a diesel engine.

BACKGROUND

In order to perform a combustion control based on a cetane value of the fuel, various apparatus detecting the cetane value with high accuracy are proposed. For example, JP-2009-144528A (U.S. Pat. No. 7,987,696B2) shows a fuel property detecting apparatus which performs a specific fuel injection in which a first quantity of the fuel and a second quantity of the fuel are injected to compute a physical quantity variation sensitivity. Then, based on a predefined relation between the physical quantity variation sensitivity and the cetane value, the apparatus determines the cetane value of the fuel.

Although the cetane value of the fuel is one of indexes expressing a fuel property, there is a fuel property which cannot be distinguished by the cetane value. Therefore, when the fuel combustion control is performed according to only the cetane value, it is likely that a fuel combustion region is concentrated in a vicinity of an inner surface of a cylinder, so that it is likely that a cooling loss and an emission of soot may not be suppressed.

SUMMARY

It is an object of the present disclosure to provide a controller for a diesel engine, which can computes an index representing a combustibility of a fuel with high accuracy.

A controller for a diesel engine having a fuel injector, comprising: a middle-combustion time computing portion which computes a middle-combustion time period that has elapsed from the fuel is injected until a half of the fuel has combusted, based on a detection value of a cylinder pressure sensor; and a fuel component computing portion which computes a ratio of a carbon quantity relative to a hydrogen quantity contained in the fuel based on the middle-combustion time period.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
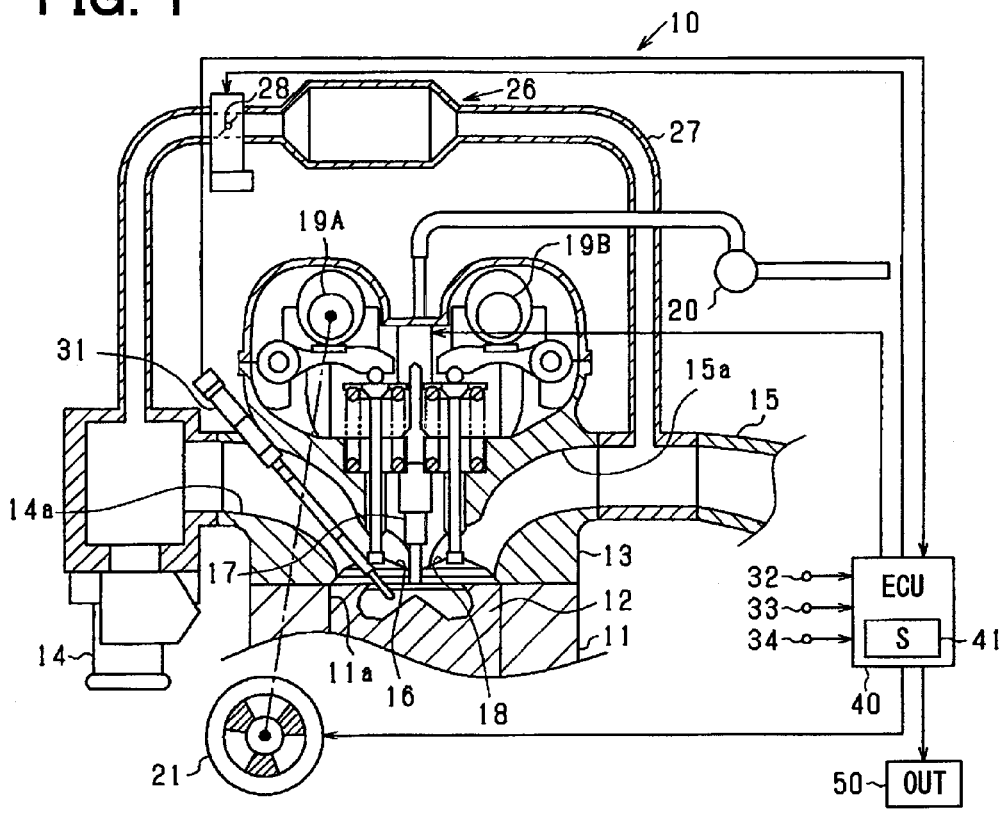
FIG. 1 is a schematic view showing a diesel engine control system.

Hereinafter, embodiments of a controller for a diesel engine will be described. The same parts and components as those in each embodiment are indicated with the same reference numerals and the same descriptions will not be reiterated.

First Embodiment

Referring to FIG. 1, a configuration of a diesel engine 10 will be described. The diesel engine 10 is an in-line four-cylinder diesel engine. FIG. 1 shows only one cylinder. The diesel engine 10 has a cylinder block 11, a piston 12, a cylinder head 13, an intake passage 14, an exhaust passage 15, an intake valve 16, a fuel injector 17, an exhaust valve 18, a variable valve timing mechanism 21, and an EGR system 26.

The cylinder block 11 forms four cylinders 11*a* therein. A piston 12 reciprocates in each cylinder 11*a*. The cylinder head 13 is provided on the cylinder block 11. The cylinder 11*a*, the piston 12 and the cylinder head 13 define a combustion chamber.

The intake passage 14 is connected to the cylinder block 11. The intake passage 14 communicates with each cylinder 11*a* through a head passage 14*a* of the cylinder head 13 and an intake manifold. Cam shafts 19A, 19B are rotated by a crankshaft (not shown) of the diesel engine 10. Each intake valve 16 is driven by the cam shaft 19A to open and close the head passage 14*a*. The variable valve timing mechanism 21 adjusts a valve timing of the intake valve 16.

An exhaust passage 15 is connected to the cylinder block 11. The exhaust passage 15 communicates with each cylinder 11*a* through a head passage 15*a* of the cylinder head 13 and an exhaust manifold. Each exhaust valve 18 is driven by the cam shaft 19B to open and close the head passage 15*a*.

A common-rail 20 accumulates the high-pressure fuel therein. The fuel is supplied to the common-rail 20 by a fuel pump (not shown). The fuel injector 17 injects the fuel in the common-rail 20 into the cylinder 11*a*. The fuel injector 17 is a well-known electromagnetic valve or a piezo drive valve which controls fuel injection quantity by controlling a pressure in a control chamber biasing the nozzle needle in a close direction. A valve-opening period of the fuel injector 17 is controlled based on an energization period of an electromagnetic actuator or a piezo drive actuator. As the valve-opening period becomes longer, the injected fuel quantity becomes larger.

The EGR system 26 (exhaust gas recirculation system) is provided with an EGR passage 27 and an EGR valve 28. The EGR passage 27 connects the exhaust passage 15 and the intake passage 14. The EGR valve 28 is provided in the EGR passage 27 to open/close the EGR passage 27. The EGR system 26 introduces a part of the exhaust gas in the exhaust passage 15 into the intake air in the intake passage 14 according to an opening degree of the EGR valve 28.

During an intake stroke, a fresh air is introduced into the cylinder 11*a* through the intake passage 14. During the compression stroke, the air is compressed by the piston 12. Around the compression top dead center, the fuel injector 17 injects the fuel into the cylinder 11*a*. During the power stroke, the injected fuel is self-ignited. During the exhaust stroke, the exhaust gas is discharged through the exhaust passage 15. A part of the exhaust gas in the exhaust passage 15 is introduced into the intake air in the intake passage 14 by the EGR system 26.

The diesel engine 10 is provided with a cylinder pressure sensor 31 which detects the cylinder pressure in the cylinder 11*a*. It is not always necessary to provide the cylinder pressure sensor 31 to all cylinders 11*a*. At least one of the cylinders 11*a* is provided with the cylinder pressure sensor 31. A fuel density sensor 32, a kinematic viscosity sensor 33, and a fuel quantity sensor 34 are provided to a fuel tank (not shown) of the diesel engine 10. The fuel density sensor 32 detects the density of the fuel supplied to the fuel injector 17. The fuel density sensor 32 detects the density of the fuel, for example, based on a natural vibration period measuring method. The kinematic viscosity sensors 33 are a capillary viscometer or a kinematic viscosity meter based on a thin wire heating method, which detects the kinematic viscosity of the fuel in a fuel tank. The fuel quantity sensor 34 detects the quantity of the fuel in the fuel tank. It should be noted that the fuel density sensor 32 and the kinematic viscosity sensor 33 are provided with a heater which heats the fuel up to a specified temperature. Under such a condition, the fuel density and the fuel kinematic viscosity are detected.

An electric control unit (ECU) 40 is a well-known computer having a CPU, a ROM, a RAM, a storage device 41 and an I/O, which controls the diesel engine 10.

The ECU 40 controls the fuel injector 17, the variable valve timing mechanism 21 and the EGR system 26 based on detected values of the various sensors, such as a crank angle sensor, a cooling-water-temperature sensor, an accelerator position sensor, the cylinder pressure sensor 31, the fuel density sensor 32, the kinematic viscosity sensor 33, and the fuel quantity sensor 34. Specifically, the control conditions of the fuel injector 17, the variable valve timing mechanism 21 and the EGR system 26 are adapted to optimize the fuel combustion condition for a standard property fuel. The ECU 40 controls each apparatus based on the detected values of the various sensors so as to obtain the optimum fuel combustion condition (normal combustion control). The ECU 40 performs a pilot injection and a main injection with the fuel injector 17.

Also, the ECU 40 performs various programs stored in the ROM, whereby the ECU 40 functions as a middle-combustion time computing portion, a fuel component computing portion, a soot amount determining portion, a switching portion, a warning portion, and a memory portion.

Figure 2:
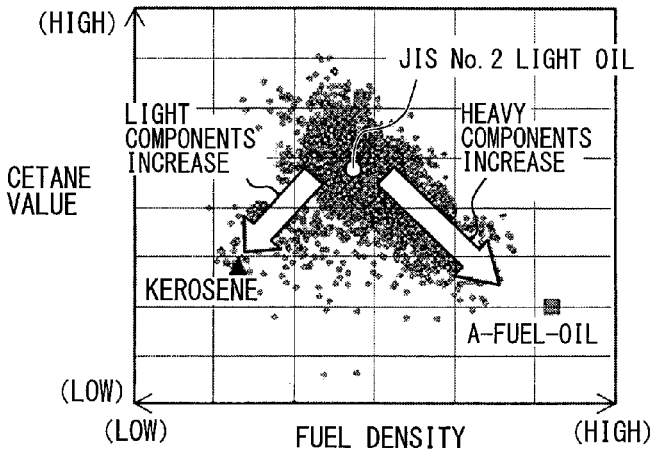
FIG. 2 is a distribution chart showing a distribution of the fuel with respect to a fuel density and a cetane value.

FIG. 2 is a distribution chart showing a distribution of the fuel with respect to a fuel density and a cetane value. The fuel used for the diesel engine 10 is classified into No. 2 according to Japanese Industrial Standard (JIS) K2204. The fuel is roughly distributed from the kerosene to the A-fuel-oil around the JIS No. 2 light oil. The fuel around the kerosene is the light fuel containing light components. The fuel around the A-fuel-oil is the heavy fuel containing heavy components. As the fuel contains more light components, the fuel density becomes lower. As the fuel contains more heavy components, the fuel density becomes higher. The cetane value becomes lower from the JIS No. 2 light oil to the kerosene. The cetane value becomes lower from the JIS No. 2 light oil to the A-fuel-oil.

That is, even if the cetane value is the same value, the fuel may be the light fuel or the heavy fuel. Although the light fuel has less ignitability, soot is less generated. The heavy fuel has less ignitability and generates soot. The soots are particles of carbon, which are generated at the time of incomplete combustion due to insufficient oxygen. Thus, although the cetane value is an index showing the ignitability, it is insufficient as an index which denotes the combustibility exactly. Even if the fuel injection quantity, the valve timing of the intake valve 16 and the EGR quantity (exhaust gas recirculation quantity) are controlled according to the cetane value, it is likely that the fuel combustion may not be controlled appropriately.

According to the present inventor's study, a ratio of the hydrogen quantity to the carbon quantity, which are contained in the fuel, that is, a ratio of the hydrogen molecule to the carbon molecule is an index which indicates the fuel combustibility. The ratio will be denoted by "C/H", hereinafter. As the ratio "C/H" becomes larger, the carbon molecule relative to the hydrogen molecule becomes larger, so that the fuel becomes less combustible. For example, when the straight chain of the molecule contained in the fuel becomes short, the rate of the side chain of the molecule is increased. When the rate of the side chain component is increased, the hydrogen molecule is decreased, so that the ratio "C/H" becomes larger. It should be noted that the ratio "C/H" may be replaced by the ratio of the carbon quantity to the hydrogen quantity "H/C".

Figure 3:
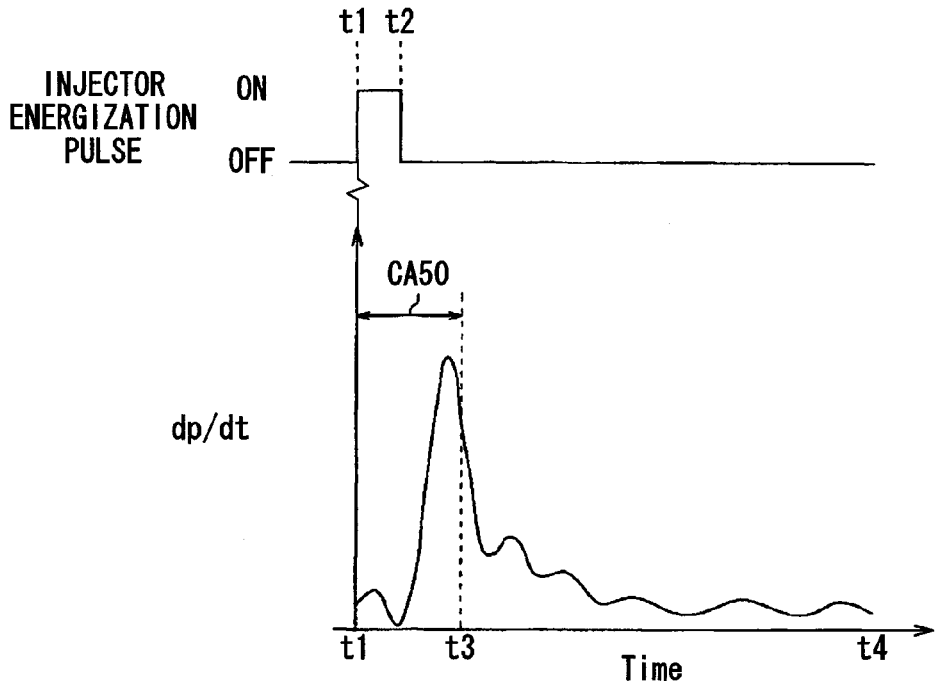
FIG. 3 is a time chart showing a middle-combustion time.

Furthermore, according to the inventor's study, it has become apparent that the middle-combustion time has high correlation with the ratio "C/H". The middle-combustion time is a time period that has elapsed from the fuel is injected through the fuel injector 17 until 50% of the fuel has burned. The middle-combustion time is denoted by "CA50", hereinafter. FIG. 3 is a chart showing an energization pulse supplied to the fuel injector 17 and an increasing speed "dp/dt" of a pressure "P". The pressure "P" is obtained by subtracting a compression pressure by the piston 12 from the cylinder pressure detected by the cylinder pressure sensor 31. Thus, the increasing speed of the pressure "P" is obtained by subtracting a compression pressure increase speed by the piston 12 from the cylinder pressure increase speed, which is detected by the cylinder pressure sensor 31. The pressure "P" increases according to an increase in heat quantity in the cylinder 11*a* by the fuel combustion. Therefore, in FIG. 3, the waveform showing the increasing speed of the pressure "P" corresponds to a waveform representing a heat release rate, and the area of the waveform corresponds to generated heat quantity.

In the present embodiment, as shown in FIG. 3, a time period that has elapsed from the fuel injector is energized at a time t1 until 50% of the heat quantity is generated at a time t3 is defined as the time "CA50". At the time t3, the area of the waveform becomes 50% of the whole area of the waveform from the time t1 to the time t4. It should be noted that the heat generation in the cylinder 11*a* is terminated and the increasing speed of the pressure "P" becomes zero at the time t4.

Figure 4:
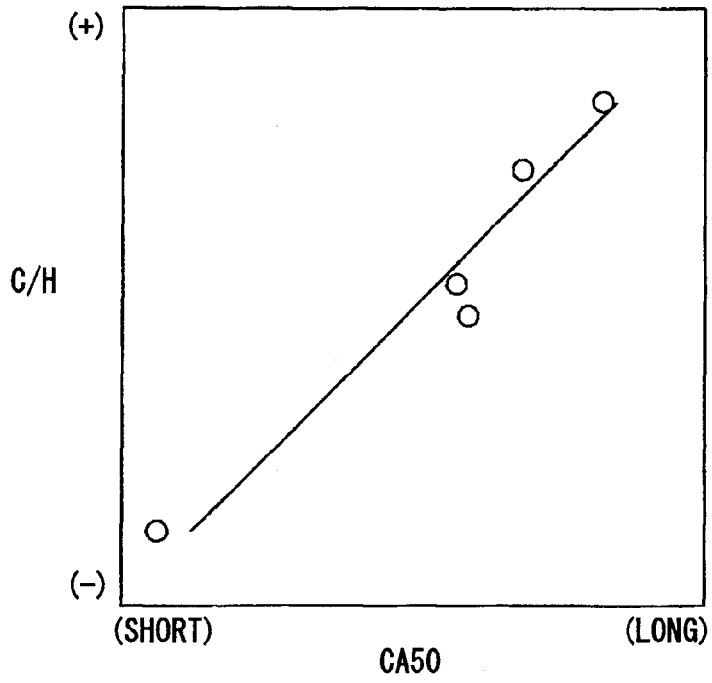
FIG. 4 is a distribution chart showing a distribution of the fuel with respect to a middle-combustion time and a ratio "C/H"
Figure 5:
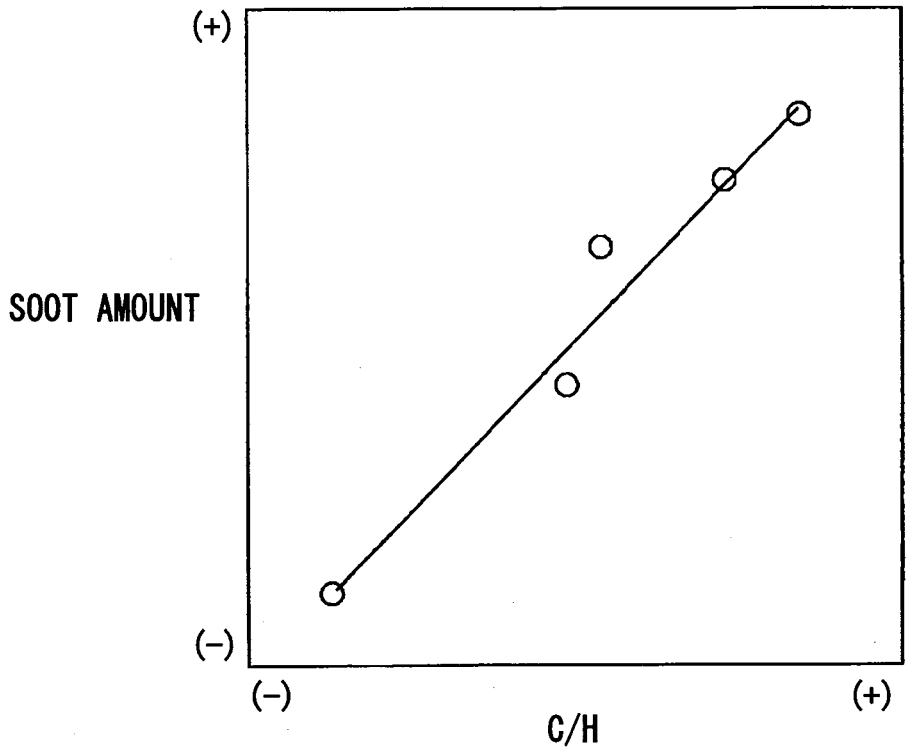
FIG. 5 is a distribution chart showing a distribution of the fuel with respect to the ratio "C/H" and soot amount.

FIG. 4 is a chart showing a fuel distribution with respect to the time "CA50" and the ratio "C/H". FIG. 5 is a chart showing a fuel distribution with respect to the ratio "C/H" and the amount of soot. The amount of soot is the discharged amount when a normal combustion control is performed. As the time "CA50" is longer, the ratio "C/H" is greater and the discharged soot amount is more increased. In a case that the discharged soot amount is greater than a specified value, it is preferable to switch the combustion control to restrict the discharged soot amount.

In the present embodiment, the combustion control is switched based on the ratio "C/H". A middle-combustion time computing portion computes a time "CA50" based on the detected value of the cylinder pressure sensor 31. The fuel component computing portion computes the ratio "C/H" based on the time "CA50" computed by the middle-combustion time computing portion and a relationship between the time "CA50" and the ratio "C/H", which is obtained by experiments in advance. The relationship is stored in the storage device 41 as a map or a correlation function.

The soot amount determining portion determines whether the fuel is the high-smoke fuel based on the ratio "C/H" computed by the fuel component computing portion. The high-smoke fuel generates a large amount of soot, which is greater than a predetermined amount, when the high-smoke fuel is combusted under a normal combustion control. The soot amount determining portion determines whether the computed ratio the ratio "C/H" is greater than a specified value, which corresponds to the predetermined amount of the soot. Alternatively, the soot amount determining portion computes the amount of the soot according to a relationship between the ratio "C/H" and the amount of the soot. Then, the soot amount determining portion determines whether the computed amount of the soot is greater than the predetermined amount. In a case that the soot amount determining portion determines that the fuel is the high-smoke fuel, the switching portion changes the combustion control from the normal combustion control to a soot-suppressing control.

When the ratio "C/H" is excessively large or small, it may cause a fault of the diesel engine 10. In the case that the ratio "C/H" is out of a specified range, the warning portion sends a command signal toward an output unit 50 to output a warning. In the case that the ratio "C/H" is within the specified range, the diesel engine 10 receives no adverse effect under the normal combustion control or the soot-suppressing control. The output unit 50 is a loudspeaker or a display. By outputting the warning, a driver is notified that the fuel is improper fuel. Moreover, in the case that the ratio "C/H" is out of the specified range, the storage device 41 sores the information that the fuel is improper. Thereby, the cause of fault can be specified when fault arises in the diesel engine 10 later.

Figure 6:
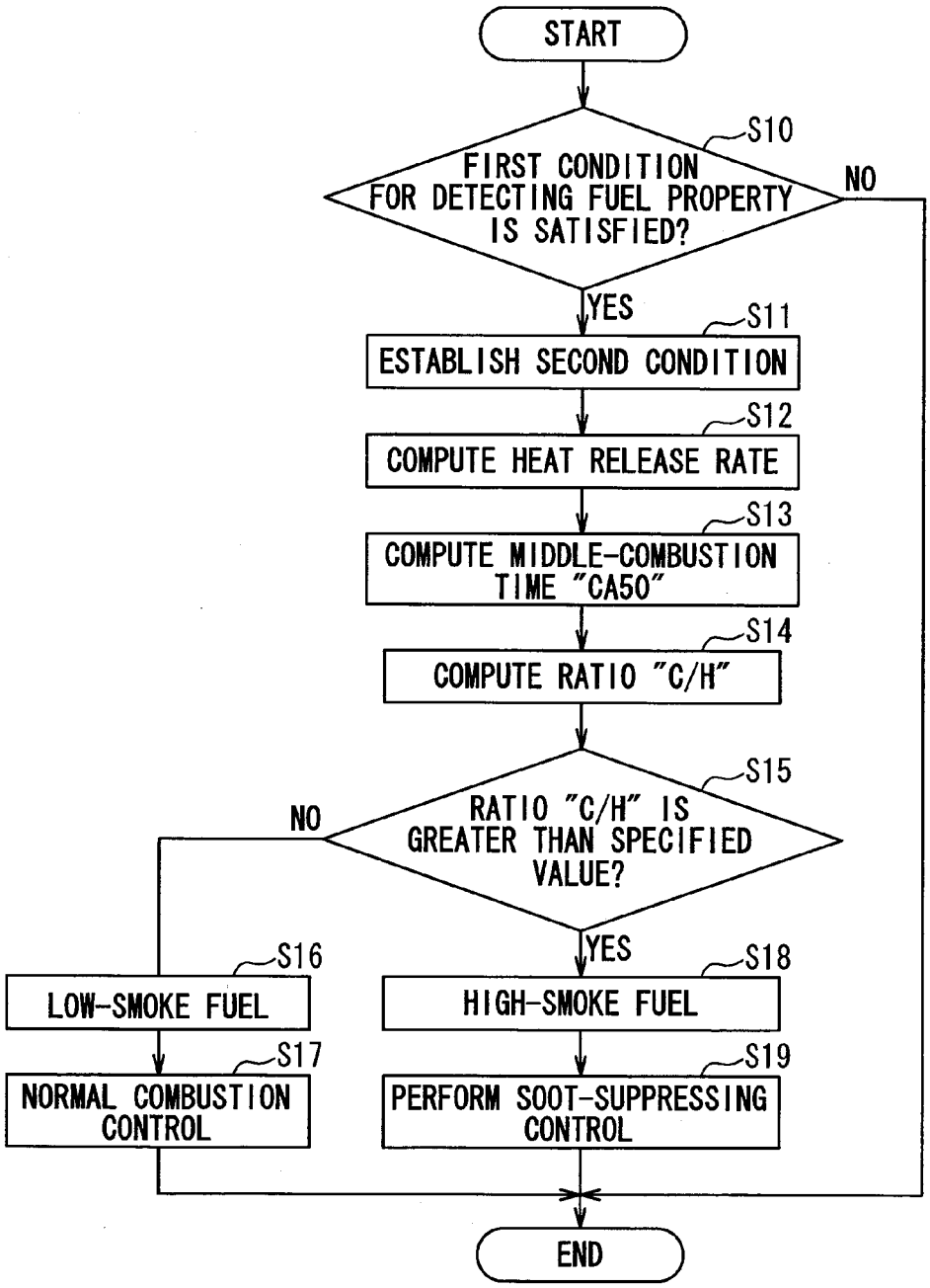
FIG. 6 is a flow chart showing a procedure of a combustion control according to a first embodiment.

Referring to a flowchart shown in FIG. 6, the processing of a combustion control of the diesel engine 10 will be described hereinafter. The ECU 40 executes the processing repeatedly in a specified period.

In S10, the ECU 40 determines whether a first condition for detecting the fuel property is satisfied. Specifically, the first condition is satisfied when refueling is performed, the rotational speed of the diesel engine 10 is constant, the warming-up is completed, and the coolant temperature is higher than a prescribed temperature (for example, 80° C.). That is, the first condition is that the refueling is performed and the diesel engine 10 is in a stable state. It is determined whether refueling is performed or not based on the fuel quantity detected by the fuel quantity sensor 34. It is determined whether the rotational speed of the diesel engine 10 is constant based on the detection value of the crank angle sensor. Moreover, it is determined whether the coolant temperature is higher than the prescribed temperature based on the detection value of the coolant temperature sensor.

When the answer is NO in S10, the processing is terminated. Meanwhile, when the answer is YES in S10, the procedure proceeds to S11 in which a second condition for detecting the fuel property is established. Specifically, the second condition is a condition for performing a fuel injection so as to detect an opening and closing timing of the intake valve 16 adjusted by the variable valve timing mechanism 21, the fuel injection quantity of the fuel injector 17, and a fuel injection timing. It should be noted that the fuel injection for detection is performed only in the cylinder 11*a* to which the cylinder pressure sensor 31 is provided.

In S12, a temporal change in heat release rate is computed. That is, the ECU 40 computes a waveform which shows the increasing speed "dp/dt" of the pressure "P". In S13, the ECU 40 computes the time "CA50" based on the waveform showing the increasing speed "dp/dt" of the pressure "P".

In S14, the ECU 40 computes the ratio "C/H" of the fuel according to a map showing a relationship between the time "CA50" and the ratio "C/H". In S15, the ECU 40 determines whether the ratio "C/H" computed in S14 is greater than a specified value. In S15, the ECU 40 may determine whether the computed soot amount is greater than a specified amount according to the map showing a relationship between the ratio "C/H" and the soot amount.

When the answer is NO in S15, the procedure proceeds to S16 in which the ECU 30 determines that the fuel is the low-smoke fuel. Then, the procedure proceeds to S17 in which the normal combustion control is performed. Specifically, the ECU 40 controls the injector 17, the variable valve timing mechanism 21, and the EGR system 26 based on the detection values of various sensors, whereby the fuel injection quantity, the opening and closing timing of the intake valve 16 and an opening degree of the EGR valve of the EGR system 26 can be adjusted. Then, the processing is terminated.

Meanwhile, when the answer is YES in S15, the procedure proceeds to S18 in which the ECU 30 determines that the fuel is the high-smoke fuel. Then, the procedure proceeds to S19 in which the soot-suppressing control is performed. In the soot-suppressing control, the oxygen quantity for combusting the fuel is increased. Specifically, at least one of the following three controls is performed. That is, in a first control, the opening degree of the EGR valve 28 is decreased more than that in the normal combustion control. In a second control, the fuel pressure in the common-rail 20 is increased by the fuel supply pump so that the fuel injection pressure of the fuel injector 17 is increased. In a third control, the intake pressure is increased by the variable valve timing mechanism 21. Moreover, as the soot-suppressing control, an after-injection may be performed. The after-injection corresponds to a fuel injection which is conducted after the main fuel injection by the fuel injector 17. The soot-suppressing control is continued until the combustion control is switched to the normal combustion control.

It should be noted that the ECU 40 may determines whether the computed ratio "C/H" is within the specified range in S15. In the case that the ratio "C/H" is out of the specified range, the warning portion sends a command signal toward the output unit 50 to output a warning. The storage device 41 sores the information that the fuel is improper.

According to the above first embodiment, following advantages can be obtained.

Based on the detection value of the cylinder pressure sensor 31, the middle-combustion time "CA50" is computed. Since the time "CA50" and the ratio "C/H" have high correlation with each other, the ratio "C/H" can be computed based on the time "CA50". The ratio "C/H" is an index which exactly represents the combustibility of the fuel.

Since the ratio "C/H" represents the combustibility of the fuel, it can be determined whether the fuel is the high-smoke fuel based on the computed ratio "C/H". When it is determined that the fuel is the high-smoke fuel, the combustion control is switched from the normal combustion control to the soot-suppressing control. Therefore, even when the fuel is the high-smoke fuel, the emission amount of soot can be suppressed.

The ratio "C/H" can be computed based on the computed time "CA50" and the corresponding relation between the time "CA50" and the ratio "C/H".

In the case that the ratio "C/H" is out of the specified range, the warning portion sends a command signal toward an output unit 50 to output a warning. By outputting the warning, a driver is notified that the fuel is an improper fuel.

In the case that the ratio "C/H" is out of the specified range, the storage device 41 sores the information that the fuel is improper. Thereby, the cause of fault can be specified when fault arises in the diesel engine 10 later.

Second Embodiment

According to a second embodiment, based on the ratio "C/H" and the fuel kinematic viscosity, the ECU 40 computes a specified combustion position in the cylinder 11*a*, and performs the combustion control according to the combustion position. The combustion control of the second embodiment will be described below.

Figure 7:
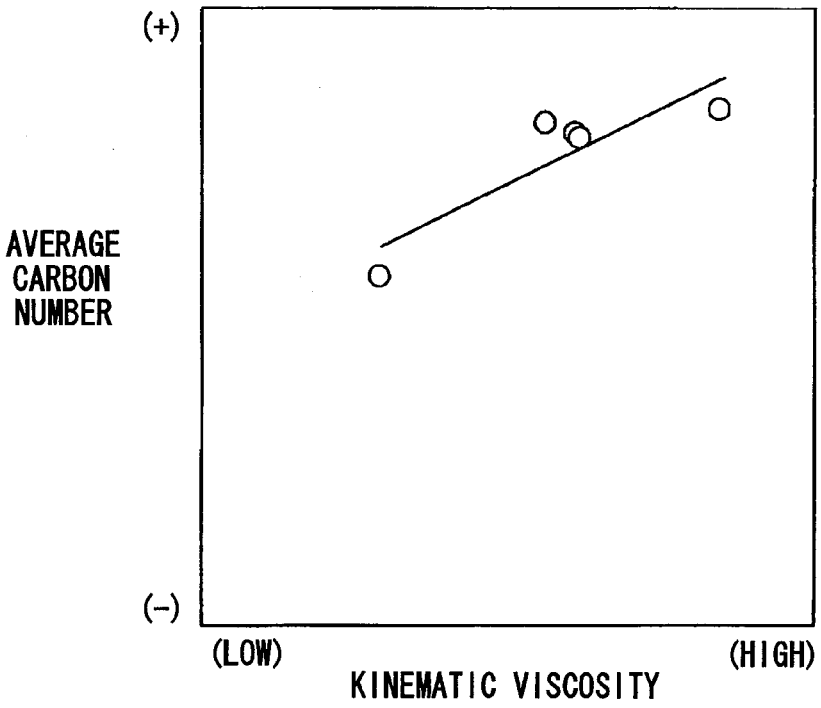
FIG. 7 is a distribution chart showing a distribution of the fuel with respect to a kinematic viscosity and an average carbon number.

FIG. 7 shows a distribution of the fuel with respect to its kinematic viscosity and its average carbon number. As the fuel kinematic viscosity becomes higher, the carbon number contained in the fuel becomes larger and the boiling point of the fuel becomes higher. As the boiling point of the fuel becomes higher, the fuel injected through the fuel injector 17 is less evaporated. The injected fuel is atomized at a position where is far from an injection port of the fuel injector 17. Meanwhile, as the fuel kinematic viscosity becomes lower, the carbon number contained in the fuel becomes smaller and the boiling point of the fuel becomes lower. As the boiling point of the fuel becomes lower, the fuel injected through the fuel injector 17 is more evaporated. The injected fuel is atomized at a position where is close to the injection port of the fuel injector 17.

According to the present inventor's study, it becomes apparent that two parameters of the ratio "C/H" and the fuel kinematic viscosity have the high correlation with the combustion position in the cylinder 11*a*. Specifically, the combustion position is a combustion tip position which is most apart from the injection port of the fuel injector 17 in the combustion region.

In a case that the combustion tip position is close to an inner surface of the cylinder 11*a*, the combustion region is close to the inner wall of the cylinder 11*a*, whereby the cooling loss becomes large and the fuel economy may be deteriorated. In a case that the combustion tip position is close to the injection port of the fuel injector 17, the combustion region is close to the injection port of the fuel injector 17, whereby the oxygen quantity necessary for the fuel combustion runs short and the fuel economy may be deteriorated. According to the second embodiment, the ECU 40 computes the combustion tip position and performs the combustion control so that the combustion tip position is brought into a specified region.

A kinematic viscosity obtaining portion obtains the detected value of the kinematic viscosity detected by the kinematic viscosity sensor 33. A combustion position computing portion computes the combustion tip position based on the computed ratio "C/H", the obtained kinematic viscosity, and a relationship between the ratio "C/H", the average carbon number and the combustion tip position.

An injection pressure reducing portion reduces the fuel injection pressure when the computed combustion tip position is apart from the specified region. Thereby, the fuel injection speed is decreased and the fuel spray travel becomes short. It can be suppressed that the combustion region is concentrated in the vicinity of the inner surface of the cylinder 11*a*. Moreover, an injection pressure increasing portion increased the fuel injection pressure when the computed combustion tip position is close to the specified region. Thereby, the fuel injection speed is increased and the fuel spray travel becomes long. It can be suppressed that the combustion region is concentrated at the injection port of the fuel injector 17.

Figure 8:
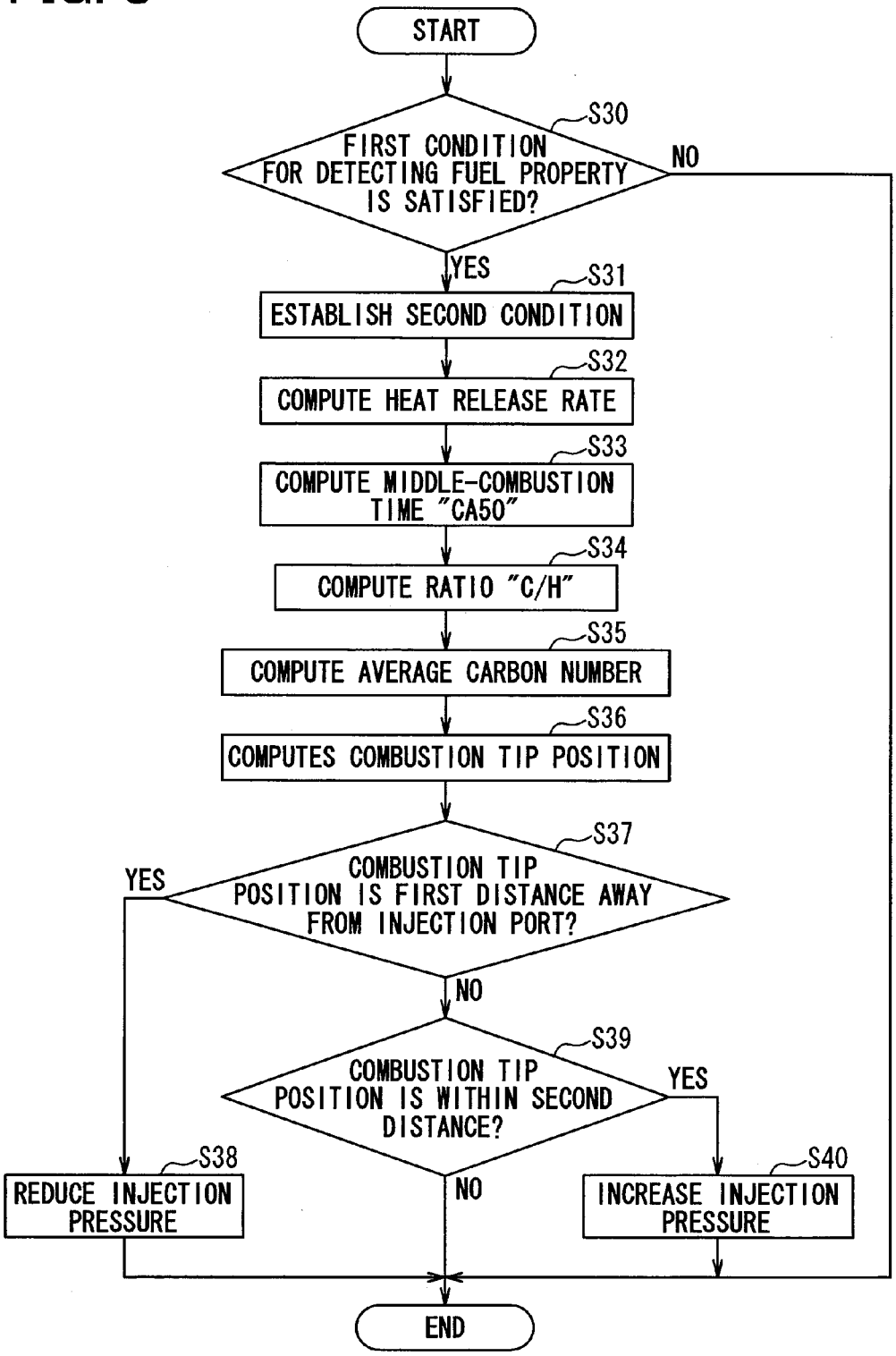
FIG. 8 is a flow chart showing a procedure of a combustion control according to a second embodiment.

Referring to a flowchart shown in FIG. 8, the processing of a combustion control of the diesel engine 10 will be described hereinafter. The ECU 40 executes the processing repeatedly in a specified period.

The processing in S30-S34 are the same as the processing in S10-S14. In S35, the ECU 40 obtains the kinematic viscosity detected by the kinematic viscosity sensor 33, and computes the average carbon number in view of a map showing a relationship between the kinematic viscosity and the average carbon number.

In S36, the ECU 40 computes the combustion tip position in view of the ratio "C/H" computed in S34, the average carbon number computed in S35, and a map showing a relationship between the ratio "C/H", the average carbon number and the map showing the relationship between the ratio "C/H", the average carbon number and the combustion tip position.

In S37, the ECU 40 determines whether the combustion tip position computed in S36 is a first distance away from the injection port of the fuel injector 17. In a case that the combustion tip position is the first distance away from the injection port of the fuel injector 17, it can be determined that the combustion region is concentrated on the inner surface of the cylinder 11*a*. When the answer is YES in S37, the procedure proceeds to S38 in which the injection pressure of the fuel injector 17 is reduced to terminate the processing.

Meanwhile, when the answer is NO in S37, the procedure proceeds to S39 in which the ECU 40 determines whether the combustion tip position is within a second distance from the injection port of the fuel injector 17. The second distance is shorter than the first distance. When the combustion tip position is within the second distance, it can be determined that the combustion region is concentrated at the injection port of the fuel injector 17. The combustion tip position should be in a specified region between the second distance and the first distance. When the combustion tip position is out of the specified region, it is likely that the fuel economy may be deteriorated.

When the answer is YES in S39, the procedure proceeds to S40 in which the injection pressure of the fuel injector 17 is increased to terminate the processing. Meanwhile, when the answer is NO in S39, the processing is terminated.

It should be noted that the ECU 40 may determines whether the ratio "C/H" computed in S34 is within the specified range. In the case that the ratio "C/H" is out of the specified range, the storage device 41 sores the information that the fuel is improper. Alternatively, a loudspeaker or a display indicates that the fuel is improper.

According to the above second embodiment, following advantages can be obtained.

Since the two parameters of the ratio "C/H" and the fuel kinematic viscosity have high correlation with the combustion tip position in the combustion region, the combustion tip position can be computed based on the ratio "C/H" and the fuel kinematic viscosity.

In a case that the combustion tip position is the first distance away from the injection port of the fuel injector 17, the fuel injection pressure is reduced. Thereby, the fuel injection speed is decreased and the fuel spray travel becomes short. It can be suppressed that the combustion region is concentrated in the vicinity of the inner surface of the cylinder 11*a*. It can be suppressed that the fuel economy is deteriorated.

In a case that the combustion tip position is within the second distance from the injection port of the fuel injector 17, the fuel injection pressure is increased. Thereby, the fuel injection speed is increased and the fuel spray travel becomes long. It can be suppressed that the combustion region is concentrated at the injection port of the fuel injector 17. It can be suppressed that the fuel economy is deteriorated.

The combustion tip position can be computed based on the computed ratio "C/H", the obtained kinematic viscosity, and a relationship between the ratio "C/H", the average carbon number and the combustion tip position.

According the computed combustion tip position in a combustion region, it can be determined whether the combustion region is concentrated in a vicinity of the inner surface of the cylinder 11*a* or in a vicinity of the injection port of the fuel injector 17.

Other Embodiment

Figure 9:
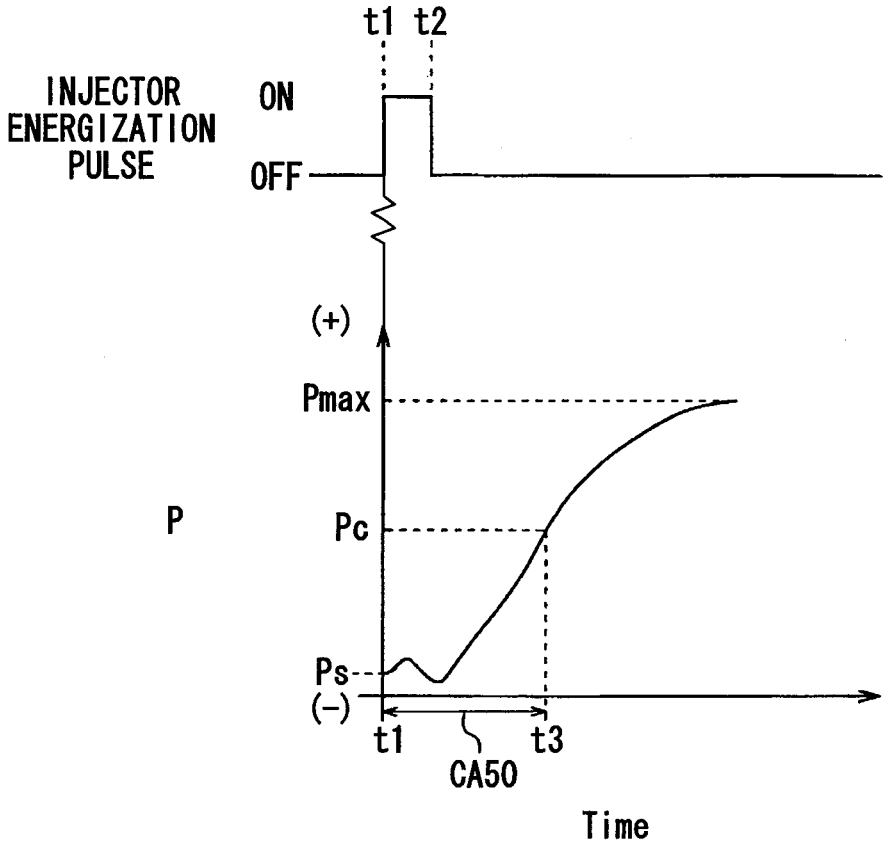
FIG. 9 is a time chart showing a middle-combustion time.

As shown in FIG. 9, the fuel injection pressure P at a time t1 is denoted by "Ps". The fuel injector 17 is energized at the time t1. The maximum pressure is denoted by "Pmax". When the pressure P is increased by (Pmax−Ps)/2 from "Ps" to "Pc" at a time t3, half of the total heat quantity is generated. Therefore, a time period from the time t1 to the time t3 may be defined as the time "CA50". Moreover, the middle-combustion time "CA50" may be measured from a time when an ignition timing (dp/dt and P become minimum values). Moreover, the middle-combustion time "CA50" may a time period that has elapsed until the half of the total heat quantity is generated.

It is not always necessary to obtain the fuel kinematic viscosity by the kinematic viscosity sensor 33. For example, the fuel pressure in the fuel passage from the common-rail to the fuel injector 17 is detected by a pressure sensor, and the pressure waveform is obtained from the detected fuel pressure. The velocity of the obtained pressure waveform is computed, and the fuel density is computed based on the velocity of the obtained pressure waveform. Based on the fuel density, the fuel kinematic viscosity may be computed. JP-2014-148906A shows the above in detail. Also, the fuel pressure in the common-rail 20 is detected by the pressure sensor, and the fuel kinematic viscosity may be computed based on the pressure waveform in the common-rail 20.

In the second embodiment, the specified position in the combustion region may be a center position of the fuel combustion instead of the combustion tip position. The center position of the combustion region is a middle position between the injection port of the fuel injector 17 and the combustion tip position. In this case, the first distance is made shorter in S37 and the second distance is made shorter in S39.

According to the center position of the combustion region, it can be determined whether the combustion region is concentrated in a vicinity of the inner surface of the cylinder 11*a* or in a vicinity of the injection port of the fuel injector 17. Furthermore, even when a large quantity of the fuel spray collides with the inner surface of the cylinder 11*a*, it can be determined that the fuel region is formed in a vicinity of the inner wall of the cylinder 11*a*.

In S38, instead of reducing the fuel injection pressure, the intake pressure in the cylinder 11*a* may be increased by an intake-pressure increasing portion. Thereby, the collision frequency between the fuel and the intake air is increased and the fuel spray travel becomes shorter. It can be suppressed that the combustion region is concentrated in the vicinity of the inner surface of the cylinder 11*a*. It can be suppressed that the fuel economy is deteriorated. Furthermore, since the oxygen quantity for the fuel combustion is increased, the fuel combustion is expedited. Also, in S38, the fuel injection pressure is reduced and the intake pressure in the cylinder 11*a* may be increased.

In S40, instead of increasing the fuel injection pressure, the intake air pressure in the cylinder 11*a* may be decreased by an intake-air-pressure decreasing portion. Thereby, the collision frequency between the fuel and the intake air is decreased and the fuel spray travel becomes longer. It can be suppressed that the combustion region is concentrated in the vicinity of the injection port of the fuel injector 17. It can be suppressed that the fuel economy is deteriorated. Also, in S40, the fuel injection pressure is increased and the intake pressure in the cylinder 11*a* may be decreased.

Both of the soot-suppressing control of the first embodiment and the combustion position control of the second embodiment may be performed. In a case that the fuel is high-smoke fuel and the combustion tip position is far from the first distance, the soot-suppressing control is performed without increasing the fuel injection pressure and the combustion position control is performed without decreasing the fuel injection pressure. Also, in a case that the fuel is high-smoke fuel and the combustion tip position is within the second distance, the soot-suppressing control is performed without increasing the intake air pressure and the combustion position control is performed without decreasing the intake air pressure so that the fuel injection pressure is increased.

What is claimed is:

1. A controller for a diesel engine having a fuel injector which injects a fuel into a cylinder, comprising:

a middle-combustion time computing portion which computes a middle-combustion time period that has elapsed from the fuel is injected until a half of the fuel has combusted, based on a detection value of a cylinder pressure sensor;

a fuel component computing portion which computes a ratio of a carbon quantity relative to a hydrogen quantity contained in the fuel based on the middle-combustion time period; and a warning portion which transmits a warning signal to an output unit to output a warning in a case that the ratio computed by the fuel component computing portion is out of a specified range;

wherein the output unit is a loudspeaker or a display.

2. A controller for a diesel engine according to claim 1, wherein the middle-combustion time period is a time period that has elapsed from a fuel injection is commanded to the fuel injector until a half of a total heat quantity is generated by a combustion of the fuel injected from the fuel injector.

3. A controller for a diesel engine according to claim 1, further comprising:

a soot amount determining portion which determines whether the fuel is a high-smoke fuel which emits a soot of which quantity is greater than a specified quantity when a normal combustion control is performed, and a switching portion which changes a combustion control from the normal combustion control to a soot-suppressing control in a case that the soot amount determining portion determines that the fuel is the high-smoke fuel.

4. A controller for a diesel engine according to claim 1, further comprising:

a kinematic viscosity obtaining portion which obtains a kinematic viscosity of the fuel, and a combustion position computing portion which computes a specified combustion position in a combustion region in the cylinder based on the ratio computed by the fuel component computing portion and the kinematic viscosity obtained by the kinematic viscosity obtaining portion.

5. A controller for a diesel engine according to claim 4, further comprising:

an injection pressure reducing portion which reduces a fuel injection pressure in a case that the specified combustion position computed by the combustion position computing portion is a first distance away from an injection port of the fuel injector.

6. A controller for a diesel engine according to claim 4, further comprising:

an intake pressure increasing portion which increases an intake air pressure in the cylinder in a case that the specified combustion position computed by the combustion position computing portion is a first distance away from an injection port of the fuel injector.

7. A controller for a diesel engine according to claim 5, further comprising:

an injection pressure increasing portion which increases the fuel injection pressure in a case that the specified combustion position computed by the combustion position computing portion is within a second distance which is shorter than the first distance.

8. A controller for a diesel engine according to claim 5, further comprising:

an intake air pressure decreasing portion which decreases the intake air pressure in the cylinder in a case that the specified combustion position computed by the combustion position computing portion is within a second distance which is shorter than the first distance.

9. A controller for a diesel engine according to claim 4, wherein the combustion position computing portion computes the specified combustion position based on the ratio of the carbon quantity relative to the hydrogen quantity contained in the fuel, and a predetermined relation between an average carbon number corresponding to the kinematic viscosity of the fuel and the specified combustion position.

10. A controller for a diesel engine according to claim 4, wherein the specified combustion position is a combustion tip position.

11. A controller for a diesel engine according to claim 4, wherein the specified combustion position is a center position of the fuel combustion.

12. A controller for a diesel engine according to claim 1, wherein the fuel component computing portion computes the ratio of the carbon quantity relative to the hydrogen quantity contained in the fuel according to a predetermined relation between the middle-combustion time and the ratio of the carbon quantity relative to the hydrogen quantity.

13. A controller for a diesel engine according to claim 1, further comprising:

a storage device which stores an information that the fuel is improper in a case that the ratio computed by the fuel component computing portion is out of a specified range.

* * * * *